US005356506A

United States Patent [19]

McNeil et al.

[11] Patent Number: 5,356,506

[45] Date of Patent: Oct. 18, 1994

[54] MODULAR CONSTRUCTION PATTERN ROLLS FOR USE IN PAPER CONVERTING

[75] Inventors: Kevin B. McNeil, Maineville, Ohio; Donald D. Culver, Edgewood, Ky.; James R. Johnson, Lawrenceburg, Ind.

[73] Assignee: The Procter & Gamble Company, Cincinnati, Ohio

[21] Appl. No.: 222,349

[22] Filed: Apr. 4, 1994

Related U.S. Application Data

[63] Continuation of Ser. No. 898,048, Jun. 12, 1992, abandoned.

[51] Int. Cl.[5] ..... B31B 1/62; B31B 1/64

[52] U.S. Cl. ..... 156/553; 162/362; 493/467

[58] Field of Search ..... 156/209, 553; 162/110, 162/111, 114, 362; 101/4, 5; 493/467, 471

[56] References Cited

U.S. PATENT DOCUMENTS

| | | | |
|---|---|---|---|
| 1,600,692 | 9/1926 | Millspaugh | 492/21 |
| 1,674,635 | 6/1928 | Burden | 492/21 |
| 1,882,480 | 10/1932 | Brueshaber | 492/18 |
| 2,290,608 | 7/1942 | Evans . | |
| 2,890,540 | 6/1959 | Britt | 101/32 |
| 3,478,141 | 11/1969 | Dempsey et al. . | |
| 3,547,723 | 12/1970 | Gresham . | |
| 3,556,907 | 1/1971 | Nystrand . | |
| 3,646,652 | 3/1972 | Heiligenthal et al. | 492/53 |
| 3,693,544 | 9/1972 | Trzyna | 492/53 |
| 3,708,366 | 1/1973 | Donnelly . | |
| 3,738,905 | 6/1973 | Thomas . | |
| 3,867,225 | 2/1975 | Nystrand . | |
| 3,940,529 | 2/1976 | Hepford et al. . | |
| 3,961,119 | 6/1976 | Thomas . | |
| 4,020,725 | 5/1977 | Climo . | |
| 4,110,152 | 8/1978 | Dunning et al. . | |
| 4,116,594 | 9/1978 | Leanna et al. . | |
| 4,211,743 | 7/1980 | Nauta et al. . | |
| 4,325,773 | 4/1982 | Schulz . | |
| 4,483,728 | 11/1984 | Bauernfeind . | |
| 4,503,769 | 3/1985 | Andersen | 101/153 |
| 4,559,106 | 12/1985 | Skytta et al. . | |
| 4,583,272 | 4/1986 | Keller | 492/53 |
| 4,705,711 | 11/1987 | Perna . | |
| 4,856,159 | 8/1989 | Skytta . | |
| 4,868,958 | 9/1989 | Suzuki et al. . | |
| 4,921,034 | 5/1990 | Burgess et al. . | |

FOREIGN PATENT DOCUMENTS

| | | |
|---|---|---|
| 0269050 | 6/1988 | European Pat. Off. . |
| 0475671A2 | 3/1992 | European Pat. Off. . |
| 1235126 | 2/1967 | Fed. Rep. of Germany . |
| 2611610 | 9/1977 | Fed. Rep. of Germany . |
| 3334447 | 4/1985 | Fed. Rep. of Germany . |
| 407639 | 3/1935 | France . |
| 168595 | 4/1983 | Japan . |
| WO91/05642 | 5/1991 | PCT Int'l Appl. . |
| WO91/13204 | 9/1991 | PCT Int'l Appl. . |

OTHER PUBLICATIONS

IBM Tech. Disclosure Bulletin, Bixby et al. vol. 18, No. 10, Mar. 1976, pp. 3204–3205.

Metals Handbook, Semiatin et al., 1988 p. 354.

*Primary Examiner*—Michael Ball

*Assistant Examiner*—Richard Crispino

*Attorney, Agent, or Firm*—Larry L. Huston; Jacobus C. Rasser; E. Kelly Linman

[57] ABSTRACT

The invention comprises a modular pattern roll for embossing a cellulosic fibrous structure. The pattern roll is made by assembling separate components, rather than being one piece and chemically etched according to the prior art. The pattern roll comprises a cylindrically perforate outer shell having radially extending protuberances inserted through the holes in the cylindrical shell. The protuberances are provided with an interference fit and/or, if desired, a shoulder at the proximal end to prevent the protuberances from being extruded and expelled through the hole and creating a missile hazard during operation. The center of the hollow cylindrically perforate shell is filled with a base roll and a radially expanding internal locking assembly, to prevent the protuberances from moving radially inwardly under the compressive forces which occur during operation.

8 Claims, 2 Drawing Sheets

MODULAR CONSTRUCTION PATTERN ROLLS FOR USE IN PAPER CONVERTING

This is a continuation of application Ser. No. 07/898,048, filed Jun. 12, 1992, abandoned.

FIELD OF THE INVENTION

The present invention relates to modular construction pattern rolls having close tolerance radially extending protuberances and a close tolerance periphery between the radially extending protuberances. The pattern rolls are used in paper converting.

BACKGROUND OF THE INVENTION

Rolls used to convert, and particularly to emboss, cellulosic fibrous structures are well known in the papermaking art. Converting refers to any post drying operation which permanently affects any property of a cellulosic fibrous structure. Converting rolls typically have a pattern of radially extending protuberances which imparts the emboss pattern to the cellulosic fibrous structure. Each roll may be integral, or may be constructed from a plurality of components assembled in a particular configuration.

A roll made from an integral assembly typically has the periphery of the roll, between the protuberances, chemically etched away, to leave only the radially extending protuberances unaffected by the etching process. The protuberances may then be machined to the final dimensions with a great deal of accuracy.

However, such an etching process leaves the periphery of the roll between the proximal ends of the protuberances: out of tolerance with respect to straightness, concentricity, and diameter. Because this periphery of the roll is not a close tolerance surface and may be out of tolerance with respect to the foregoing parameters, the roll may be unsuitable for use in manufacturing which requires a great deal of accuracy at the roll periphery.

Because the periphery of the roll is not a close tolerance surface, the periphery of the roll may be unsuitable for and hence is not used in the manufacturing process. This unsuitability represents a great waste, because, frequently, the periphery of the roll between the protuberances represents the majority of the surface area of the roll and the protuberances represent only a small percentage of the total surface area of the roll.

Various attempts in the art to provide rolls constructed as an assembly have not been successful in overcoming this waste. For example, certain attempts in the art disclose magnetically attached flexible plates to the surface of an embossing roll. The plates may be removed and replaced as desired. Other attempts have utilized interference fits to assemble the components of the roll. Examples of such attempts in the art include U.S. Pat. Nos. 4,116,594 issued Sept. 26, 1978 to Leanna et al. and 4,705,711 issued Nov. 10, 1987 to Perna.

Also attempts have been made in the art to widen the compressive zone of the nip between rolls, or to permit deflection of rolls when a fabric passes between the rolls. The art further teaches coating the roll to achieve proper compliance and hardness. Yet other attempts in the art include a roll having a telescoping assembly which permits water to drain through. Examples of such attempts in the art include U.S. Pat. No. 4,559,106 issued Dec. 17, 1985 to Skytta et al.; U.S. Pat. No. 4,856,159 issued Aug. 15, 1989 to Skytta; U.S. Pat. No. 4,868,958 issued Sept. 26, 1989 to Suzuki et al.; and the aforementioned U.S. Pat. No. 4,705,711 issued Nov. 10, 1987 to Perna.

However, none of these teachings overcome the problems of obtaining highly accurate protuberances in a roll with a close tolerance periphery between the protuberances. To achieve two close tolerance surfaces, the roll may be assembled from separate components. Each of the separate components may be machined to the desired tolerance prior to assembly. The prior art does not even teach how to assemble such a roll, even if close tolerance components were available. Furthermore, because the prior art has not utilized such a roll, the prior art does not teach the use of such roll to eliminate the waste which has heretofore been present without such close tolerance rolls being available.

BRIEF SUMMARY OF THE INVENTION

The invention comprises a roll for converting a paper laminate. The roll is a pattern roll and has a modular construction. The roll has a generally hollow cylindrically perforate outer shell with a plurality of radially oriented holes through this shell. A plurality of protuberances, each having a proximal end and a distal end, is provided. The protuberances are disposed in the holes so that the proximal ends are in engaged relationship with the shell and the distal ends of the protuberances protrude radially outwardly from the periphery of the shell. The roll further comprises a means for maintaining the protuberances and the cylindrically perforate shell in a fixed relationship. This means may comprise a radial anvil, such as is formed by a base roll used in conjunction with a radially expanding internal locking assembly.

BRIEF DESCRIPTION OF THE DRAWINGS

While the Specification concludes with claims particularly pointing out and distinctly claiming the present invention, it is believed the same will be better understood by the following Specification taken in conjunction with the associated drawings in which like components are given the same reference numeral, analogous components are designated with a prime symbol and:

DETAILED DESCRIPTION OF THE INVENTION

Figure 1:
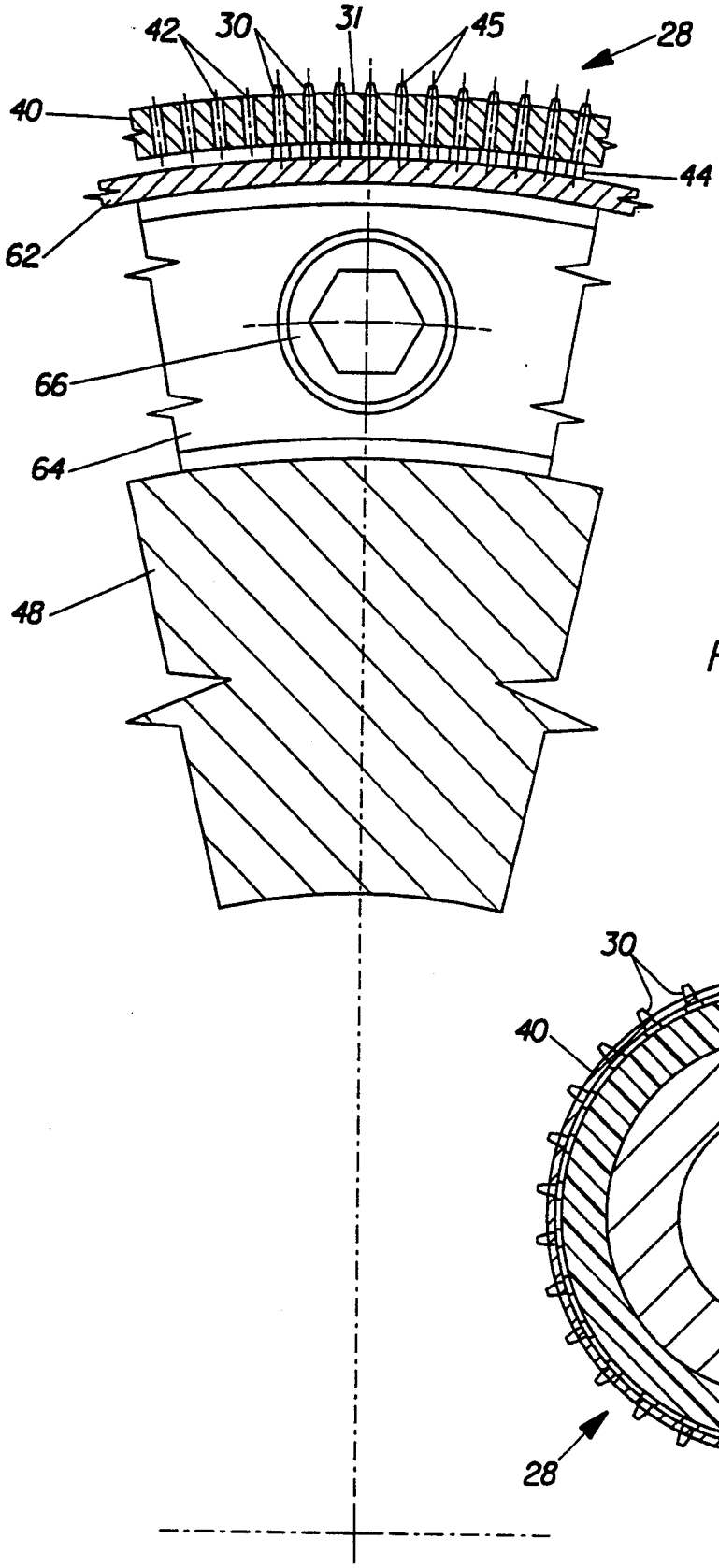
FIG. 1 is an axial sectional view of a modular pattern roll according to the present invention having a base roll, an inner shell, and a locking assembly.

Referring to FIG. 1, a pattern roll 28 according to the present invention may be made with a modular construction having various components such as protuberances 30, a base roll 48, a cylindrically perforate shell 40 to dispose the protuberances 30 in a particular pattern, an inner shell 62, and an internal locking assembly 64 to maintain the protuberances 30 and the cylindrically perforate shell 40 in fixed relationship. The cylindrically perforate shell 40 has a plurality of holes 42 therethrough. The modular pattern roll 28 is provided with a plurality of protuberances 30 which may, but does not necessarily, equal the number of holes 42.

Each protuberance 30 is inserted through a hole 42 in the cylindrically perforate shell 40 in the cylindrically perforate shell 40 and secured in place by a means for maintaining the protuberances 30 and the cylindrically perforate shell 40 in fixed relationship. This means for maintaining the protuberances 30 and the cylindrically perforate shell 40 in fixed relationship prevents the protuberances 30 from moving radially inward relative to the cylindrically perforate shell 40 or skewing from the radial direction.

Figure 2:
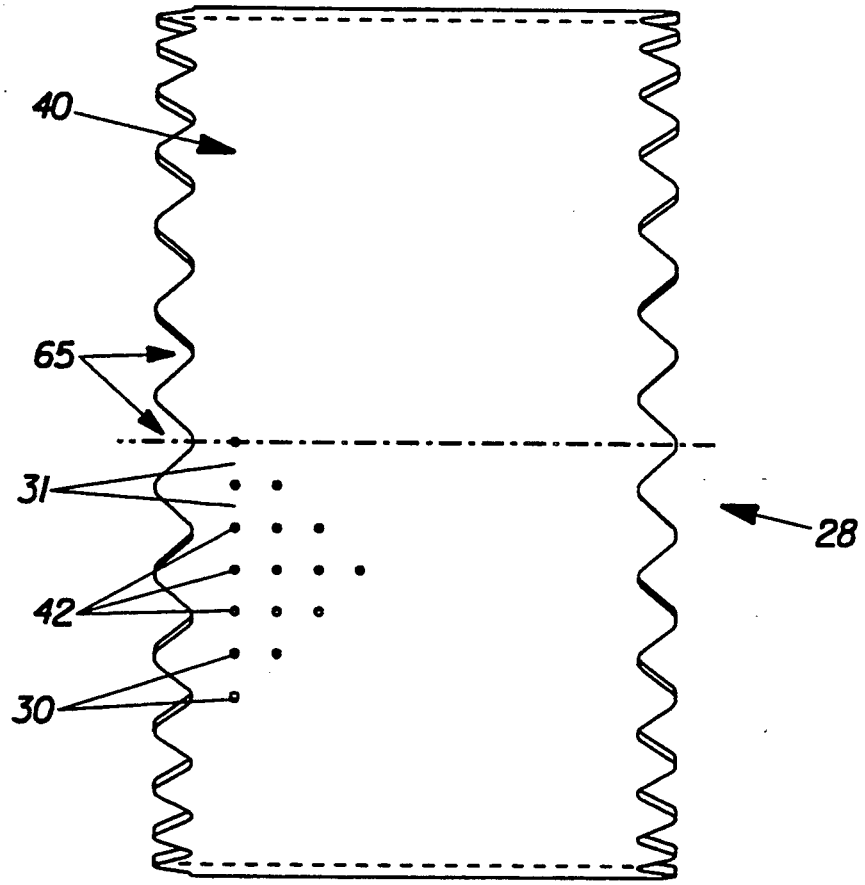
FIG. 2 is a vertical profile view of a cylindrically perforate shell utilized for the pattern roll of FIG. 1 showing some holes filled with protuberances and showing other holes without protuberances therein.

Referring to FIG. 2, a pattern roll 28 according to the present invention may be made of a modular construction, rather than as an integral component. The first component of the modular assembly is a cylindrically perforate shell 40. The outside of the cylindrically perforate shell 40 provides the "periphery" of the pattern roll 28 intermediate the protuberances 30.

The cylindrically perforate shell 40 may be made of any outside diameter desired, with a preferred diameter being about 40 to about 50 centimeters (16 to 20 inches), and for the embodiments described herein may have a diameter of about 45.4 centimeters (17.86 inches). The cylindrically perforate shell 40 has a radial thickness sufficient to withstand the stresses imposed by the embossing process described herein, and is preferably at least about 0.5 to about 1.0 centimeters (0.2 to 0.4 inches) in thickness, and for the embodiments described herein may be 0.8 centimeters (0.3 inches) in thickness.

For the embodiment described herein the cylindrically perforate shell 40 may have an outside diameter of about 45.36 centimeters (17.860 inches) and an inside diameter of about 43.79 centimeters (17.240 inches). The cylindrically perforate shell 40 may be made of carbon or high nickel alloy seamless steel tubing and machined to a concentric, straight, constant diameter periphery 31 by means and equipment which are well known in the art and will not be described herein.

By machining and, if desired, coating the periphery 31 of the pattern roll 28, a close tolerance periphery 31 can be provided, as well as close tolerance protuberances 30 made in accordance with the description set forth below. As used herein a "close tolerance" surface is machined or otherwise formed to a tolerance of ±0.00008 millimeters (±0.002 inches).

If desired, either the inside circumference or the outside periphery 31 of the cylindrically perforate shell 40 may be plated, coated, or otherwise finished as desired for purposes of hygiene, minimizing the attraction of foreign materials to the resulting pattern rolls 28 or to reduce corrosion.

The cylindrically perforate shell 40 is open on at least one end, so that an axially oriented through-hole is present, making the cylindrically perforate shell 40 hollow. Additionally, the cylindrically perforate shell 40 is provided with a plurality of radially oriented holes 42. The radially oriented holes 42 are disposed in a pattern and location corresponding to the pattern and location desired for the embossed sites of the resulting cellulosic fibrous structure.

The holes 42 in the cylindrically perforate shell 40 may be of any size and shape desired, with the understanding that the shape of the holes 42 will influence the size and shape of the protuberances used therewith. The holes 42 in the cylindrically perforate shell 40 may be aligned in the machine and cross machine directions, unilaterally staggered, bilaterally staggered, or arranged in any pattern as desired to facilitate adhesive joining and the bond strength necessary for the consumer product during use.

The disposition, size, and shape of the holes 42 are not critical, it is only important that each hole 42 in the cylindrically perforate shell 40 be radially oriented and properly spaced from the adjacent holes 42. It is also not necessary that each hole 42 be equally spaced from the adjacent holes 42, but only that the pattern of the holes 42 be known and repeatable, so that proper registration between the two pattern rolls 28 made according to this invention can be reliably achieved.

For the embodiment described herein, the holes 42 and protuberances 30 may be disposed on a pattern oriented 45 degrees from the machine direction and bilaterally offset from the next protuberance about 2.23 millimeters (0.0876 inches) in both the machine direction and cross machine direction. The holes 42 in the cylindrically perforate shell 40 may be round, having a diameter of about 2.11 millimeters (0.082 inches) for the embodiment described herein.

Figure 3:
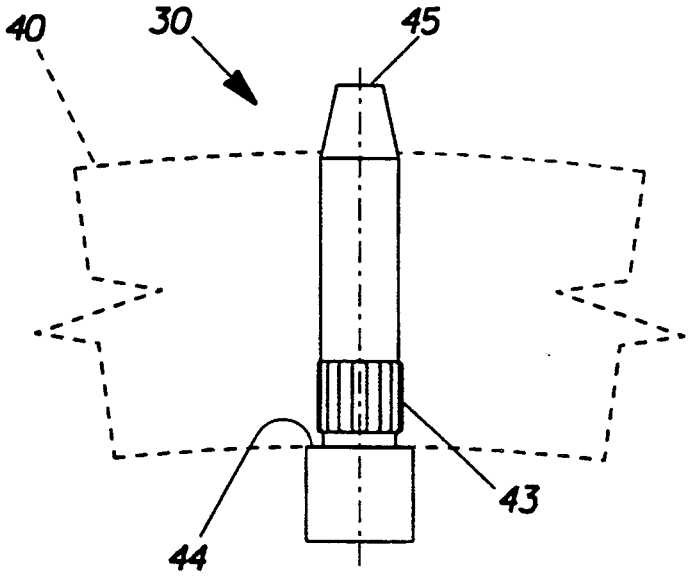
FIG. 3 is a vertical profile view of one of the protuberances shown in position in a fragmentary cross section of the cylindrically perforate shell of FIG. 2 to make the modular pattern roll of FIG. 1.

Referring to FIG. 3, the protuberances 30 used in conjunction with the modular pattern rolls 28 for the present invention are made from a single piece of steel through hardened to a hardness of at least Rockwell C 55 and preferably at least Rockwell C 60. Alloy steel such as 4340 or 52100 is suitable for the protuberances 30. If desired, the protuberances 30 may be made of a lower grade of steel and case hardened, although this process makes dimensional control more difficult.

The shank of the protuberance 30 tapers intermediate the annular shoulder 44 and the distal end 45 of the protuberance 30 at an included angle of about 26 degrees, measured from an imaginary apex beyond the distal end 45 of the protuberance 30. At the base of each protuberance 30 is an annular shoulder 44 which at least partially circumscribes the protuberance 30.

The shoulder 44 should be sized large enough so that the protuberance 30 cannot pass through the holes 47 of the cylindrically perforate shell 40 in the radially outward direction and become a missile hazard during operation. The shoulder 44 should be at least about 0.5 millimeters (0.026 inches) greater than the diameter of the holes 42 in the cylindrically perforate shell 40 and have a thickness of at least about 2.5 millimeters (0.10 inches) to prevent the protuberances 36 from being extruded through the holes and creating such a missile hazard.

The protuberances 30 should be sized in accordance with the holes 42 in the cylindrically perforate shell 40. During assembly, the protuberances 30 are inserted through the holes 42 in the cylindrically perforate shell 40 from the inside of the cylindrically perforate shell 40, so that the distal ends 45 of the protuberances 30 extend radially outwardly from the cylindrically perforate shell 40 and the shoulder 44 of the protuberance 30 contacts and is in engaged relationship with the inside circumference of the cylindrically perforate shell 40.

As illustrated in FIG. 3, the protuberances 30 may be provided with knurls 43 to prevent the protuberance 30 from rotating about on its own axis. The knurls 43 provide a space intermediate the protuberances 30 and the cylindrically perforate shell 40 for adhesive, if desired, to join these components together. Prophetically, the knurls 43 :may be replaced by a plurality, such as three, circumferential grooves to provide a space intermediate the protuberances 30 and the cylindrically perforate shell 40 for the adhesive.

The shank of the protuberances 30 may have an interference fit at the knurls 43 of about 0.03 millimeters (0.001 inches). This interference fit temporarily holds the protuberances 30 in place while the means for maintaining the protuberances 30 and cylindrically perforate shell 40 in fixed relationship are installed and assembly of the pattern roll 28 is completed.

If desired, the protuberances 30 may be permanently held in place by an interference fit and the annular shoulder 44 omitted. Such interference fit provides the means for maintaining the protuberances 30 and cylindrically perforate shell 40 in fixed relationship.

For the embodiments described herein, to be used with paper toweling having two laminate and a basis weight as presented to the consumer of about 0.04 kilograms per square meter (26 pounds per 3,000 square feet) and each lamina having a caliper prior to embossing of about 0.3 millimeters (0.012 inches), the protuberances 30 should have an axial length, which extends radially beyond the periphery 31 of the cylindrically perforate shell 40, of at least about 1.3 millimeters (0.050 inches) preferably at least about 1.8 millimeters (0.070 inches), and more preferably about 2.0 millimeters (0.080 inches), but not more than about 2.5 millimeters (0.100 inches).

It is understood that slight adjustment from the foregoing dimensions may be necessary to accommodate a cellulosic fibrous structure of greater or lesser basis weight and caliper. However, with slight adjustments, the apparatus described herein can be used to manufacture a cellulosic fibrous structure having a basis weight of about 0.01 to about 0.07 kilograms per square meter (8 to 40 pounds per 3,000 square feet), and more preferably about 0.04 to about 0.05 kilograms per square meter (25 to 30 pounds per 3,000 square feet).

Protuberances 30 of this size help to insure sufficient deflection of the cellulosic fibrous structure occurs at the embossed sites and that a difference is apparent in the elevation between the embossed sites and the nonembossed region of the laminae. This arrangement may yield a cellulosic fibrous structure having caliper of about 1.0 millimeters (0.040 inches) and a greater depth between the midpoint of the span and the embossed sites than can be achieved under like conditions utilizing the prior art.

The distal ends 45 of the protuberances 30 may have an area of about 0.01 square centimeters (0.002 square inches) with the understanding that it will produce embossed sites having a like area. For the embodiments described herein, the protuberances 30 and distal ends 45 thereof may be circular in cross section and round respectively. However, it is understood that protuberances 30 of other cross-sections and distal ends 45 which are not circular may be advantageously used with the present invention.

After the protuberances 30 are inserted through the holes 42 in the cylindrically perforate shell 40, a means for maintaining the protuberances 30 and the cylindrically perforate shell 40 in fixed relationship must be provided. The means for maintaining the protuberances 30 and the cylindrically perforate shell 40 in fixed relationship prevents the protuberances 30 from moving radially inwardly under the compressive forces present in and during the manufacturing process and which forces are caused by the compression of the distal end 45 of the protuberance 30 against the periphery 31 of the other pattern roll 28 at the proximal end of the protuberances 30 of that pattern roll 28.

One preferred means for maintaining the protuberances 30 in the cylindrically perforate shell 40 in fixed relationship is a radial anvil. As used herein a "radial anvil" refers to any structure or fixture which transmits the radial forces through the protuberances 30 to the mounting for the pattern roll 28. As is well known in the art, the pattern roll 28 may be mounted on both ends of its shaft, may be cantilevered, may be trunnion mounted, and provided with journals, bearings, or other means to allow the pattern roll 28 to axially rotate while maintaining the desired axially parallel relationship, position, and clearance with the other pattern roll 28B.

As illustrated in FIG. 1, one advantageous execution of a radial anvil which provides a satisfactory means for maintaining the cylindrically perforate shell 40 and protuberances 30 in fixed relationship comprises a central base roll 48, and an inner shell 62. The base roll 48 and inner shell 62 both are mutually concentric and each have a constant inner diameter, a constant outer diameter, and a constant radial thickness.

Examining the assembly of the foregoing components in more detail, the inner shell 62, for the embodiment described herein, may be made having an outside diameter of about 43.34 centimeters (17.063 inches) and an inside diameter of about 42.50 centimeters (16.734 inches). The proximal ends or shoulders 44, if provided, of the protuberances 30 define a circle having a smaller diameter, particularly a diameter of about 43.33 centimeters (17.060 inches), and therefore an interference fit is present.

To overcome this interference fit caused by the difference in size between the inner shell 62 and the circle defined by the insides of the protuberances 30 and to aid in assembling the inner shell 62 to the pattern roll 28, the inner shell 62 is thermally contracted. Cooling the inner shell 62 reduces its diameter, due to the associated thermal contraction. For the embodiments described herein a temperature differential of at least about 77° C. (170° F.) has been found suitable.

After the inner shell 62 is cooled it is inserted into the subassembly comprising the protuberances 30 and the cylindrically perforate shell 40. The inner shell 62 is allowed to warm to the ambient temperature and a press fit of about 0.08 millimeters (0.003 inches) is formed. This press fit maintains the protuberances 30 in fixed relationship relative to the inner shell 62 for the balance of the assembly of the pattern rolls 28.

However, this arrangement does not yet adequately transmit forces radially applied to the protuberances 30 to the mounting for the pattern rolls 28. The constant diameters and thickness base roll 48 and inner shell 62 must be joined to one another by a component.

One suitable component to join the base roll 48 and inner shell 62 and transmit the radial load therebetween is an annular collar. A simple annular collar may be of constant internal and external diameter and constant radial thickness. The annular collar may be sized to provide an interference fit between the base roll 48 and the inner shell 62, and may be axially inserted therebetween using a hydraulic press as is well known in the art.

A particularly preferred annular collar is radially adjustable in thickness. While many annular collars may be suitable and used in the art, one component which is radially adjustable and has been used with success is an internal locking assembly 64. An internal locking assembly 64 may be inserted into the annular space between the base roll 48 and the inner shell 62 in a loose condition, then tightened using the axially oriented threaded fasteners 66 commonly supplied and associated with such internal locking assemblies 64 to radially expand the internal locking assembly 64.

The locking assembly 64 should be sufficiently sized to transmit the torque from the drive unit through the base roll 48 or whatever component of the pattern roll 28 which is connected to the drive unit, to the inner shell 62 and eventually to the cylindrically perforate shell 40 without inimical angular deflection therebetween. A self-centering internal locking assembly 64 has been found advantageous, as it is important that concentricity be maintained in the modular pattern rolls 28. A Series 303 size 340×425 self-centering internal locking assembly 64 sold by the Ringfeder Company of Westwood, N.J., has been found suitable for the embodiments described herein.

If the pattern of the protuberances 30 is sparse enough or axially short enough, or, alternatively, the internal locking assembly 64 is axially long enough, the inner shell 62 may be omitted. In this embodiment, the internal locking assembly 64 still provides the means for maintaining the protuberances 30 and cylindrically perforate shell 40 in fixed relationship.

Figure 4:
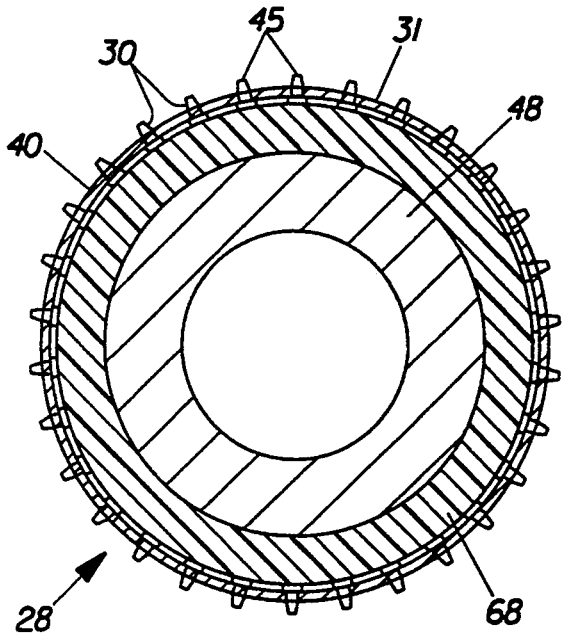
FIG. 4 is an axial vertical section view of an alternative modular pattern roll according to the present invention having a base roll, and resin in the annular space between the base roll and the cylindrically perforate shell.

Referring to FIG. 4, a less preferred means for maintaining the protuberances 30 and the cylindrically perforate shell 40 of the pattern roll 28' in fixed relationship is a hardenable resin 68 which fills the inside of the cylindrically perforate shell 40. The resin 68 may be poured, in liquid form into a vertically disposed cylindrically perforate shell 40 having the protuberances 30 installed from the inside, and allowed to harden. Once hardened, the resin 68 solidifies and prevents the protuberances 30 from moving radially inwardly, or from rotating about its axis.

Suitable resins 68 include epoxy type polymers. A particularly suitable resin 68 is sold by the Conap Company of Olean, N.Y., under the model number TE-1257, and used with EA-116 hardener.

If this means for maintaining the cylindrically perforate shell 40 and protuberances 30 in a fixed relationship is selected, the pattern roll 28' may be further provided with a base roll 48, so that the amount of resin 68 necessary to hold the protuberances 30 and cylindrically perforate shell 40 in fixed relationship is minimized. A hollow or solid cylindrical base roll 48 having a diameter slightly less than that defined by the proximal ends of the protuberances 30 may be installed and centered in the cylindrically perforate shell 40 after the protuberances are installed.

The resin 68 is poured in the annular space 50 between the base roll 48 and the cylindrically perforate shell 40. This arrangement provides the advantages of reducing the total amount of resin 68 used, which frequently has a lower modulus in compression than either the base roll 48 or the cylindrically perforate shell 40, and provides for economization of manufacture and reduces the sensitivity of the cure time to factors affecting the hardness of the resin 68 after curing.

It is understood that one disadvantage to this means is the protuberances 30 may embed in the resin 68, reducing their radial protrusion from the periphery 31 of the pattern roll 28'. This embedment can be compensated for by longer protuberances 30.

Another less preferred means for maintaining the cylindrically perforate shell 40 and the protuberances 30 in fixed relationship is the base roll 48 used to fill the cylindrically perforate shell 40 having the protuberances 30 installed through the holes 42 from the inside of the cylindrically perforate shell 40 used without resin 68. In this arrangement, the outside diameter of the base roll 48 is slightly larger than the inside diameter defined by the proximal ends of the protuberances 30. A press fit or interference fit arrangement then occurs, so that the proximal ends of the protuberances 30 impart radially compressive stresses to the base roll 48.

An interference fit may be advantageously accomplished through thermal contraction of the base roll 48. However, one disadvantage of this arrangement is that disassembly and reuse of the individual components of the pattern roll 28 is typically difficult to accomplish. Thus, for example, if one of the protuberances 130 were broken, it may be infeasible to replace just the broken protuberances 30 (a problem indigenous to the integral pattern rolls of the prior art), and the pattern roll 28 may have to be scrapped. The base roll 48 is cooled, axially inserted in the cylindrically perforate shell 40 and warmed to ambient temperatures so that exposure to the final dimension may occur.

If desired, the axial ends of the cylindrically perforate shell 40 may be provided with a means for registering 65 the cylindrically perforate shell 40 with other cylindrically perforate shells juxtaposed in axially contiguous relationship therewith. The means for registering 65 the cylindrically perforate shells 40 of axially juxtaposed and contiguous pattern rolls 28 provides for continuity of the aesthetic pattern formed by the protuberances 30 across the consumer product.

This arrangement allows a plurality of pattern rolls 28 to be axially concatenated, so that in manufacture a cellulosic fibrous structure of greater width can be advantageously constructed. Particularly, this contributes to more economical manufacture of such a cellulosic fibrous structure.

One suitable means for registering 65 the cylindrically perforate shell 40 of a pattern roll 28 to another cylindrically perforate shell 40 of an axially contiguous pattern roll 28 is irregularities in the axial ends of the cylindrically perforate shell 40.

Particularly, the axial ends of the cylindrically perforate shell 40 may be provided with scallops as illustrated, may be serrated or provided with a saw-tooth or square wave pattern. The exact size, shape, distribution, and position of the irregularities will depend upon the particular aesthetic pattern of the protuberances 30.

If desired, other patterns may be made in the pattern rolls 28 which will conform to like patterns of embossed sites and nonembossed regions in the cellulosic fibrous structure. For example, instead of discrete embossed sites and an essentially continuous nonembossed region, the pattern rolls 28 may be provided with an essentially continuous protuberance network.

Prophetically this essentially continuous protuberance network may be provided by having a cylindrical shell of the proper radial wall thickness, and drilling blind holes into the outside of the cylindrical shell. The blind holes will not compress the coincident regions of the respective lamina against the other lamina in the nip formed by the pattern rolls 28. This arrangement produces a cellulosic fibrous structure having an essentially continuous embossed site and discrete nonembossed site.

In use, two pattern rolls 28 may be juxtaposed in axially parallel relationship to form a nip therebetween. The protuberances 30 of these pattern rolls 28 may be sized so that the distal end 45 of each protuberance 30 touches the periphery 31 of the opposing pattern roll 28 between its protuberances 30.

Two embossed laminae to be joined together are interposed in the nip between the two pattern rolls 28. In this arrangement, the cellulosic fibrous structure is in contacting relationship with not only the protuberances 30, particularly the distal ends 45 of such protuberances 30, of a particular pattern roll 28, but is also in contacting relationship with the periphery 31 of such pattern roll 28. As used herein, two components are considered to be in "contacting relationship" if the components are touching and held together by compressive forces applied thereto.

This contacting relationship provides the advantage that not only do the protuberances 30 participate in and influence the embossing, or other converting operation, particularly adhesive joining, of the cellulosic fibrous structure—but also the periphery 31 of the pattern roll 28 may be utilized in the converting operation. The cellulosic fibrous structure is compressed, and hence densified, at each site in the nip where the cellulosic fibrous structure is in contacting relationship with the distal end 45 of a protuberance 30. Such compression facilitates adhesive joining of the laminae at these sites.

Furthermore, the portion of the cellulosic fibrous structure in contacting relationship with the periphery 31 of the pattern roll 28 is compressed or embossed by the protuberance 30 of the opposing pattern roll 28. This operation allows the cellulosic fibrous structure to be uniformly and equally embossed on both sides, so that a particularly pleasing aesthetic appearance is not present on just one side of the cellulosic fibrous structure.

Several variations to the foregoing are contemplated by the present invention. For example, generally, it is preferred that the two pattern rolls 28 be of equal diameter and have the same size (cross sectional area and radial length) protuberances 30. However, if desired, the cylindrically perforate shells 40 of the pattern rolls 28 may have different outside diameters, or, alternatively, the protuberances 30 of the two pattern rolls 28 may have different spacings and patterns between adjacent protuberances 30. If desired, the pattern rolls 28 may be heated by means well known in the art.

It will be apparent that there are many other variations within the scope and intent of the claimed invention, all of which are covered by the appended claims.

What is claimed is:

1. A paper laminate converting apparatus, said apparatus comprising two pattern rolls juxtaposed in axially parallel relationship to form a nip therebetween, each said pattern roll comprising:

a generally hollow integral cylindrically perforate shell having an inner circumference, an outer periphery, and a plurality of radially oriented holes therethrough;

a plurality of protuberances, each of said protuberances having a proximal end with a shoulder and having a distal end, said protuberances being disposed in said holes so that said shoulder is in engaged relation with the inner circumference of said shell and the distal ends of said protuberances protrude radially outwardly from the outer periphery of said shell; and a means for maintaining said protuberances and said hollow cylindrically perforate shell in fixed relationship wherein said means for maintaining said protuberances and said cylindrically perforate shell in fixed relationship comprises a radial anvil internal to said perforate shell wherein the protuberances of said pattern rolls are sized and spaced so that the distal end of each protuberance touches the periphery of the other said other pattern roll at a location between the protuberances of the other said pattern roll when said protuberances are in said nip, whereby a paper laminate in said nip is in contacting relationship with the distal ends of the protuberances of one said pattern roll and is also in contacting relationship with the other of said pattern rolls.

2. An apparatus according to claim 1 wherein at least one said radial anvil comprises a hardenable resin and a roll disposed inside said cylindrically perforate shell and forming an annular space between said second roll and said cylindrically perforate shell, whereby said resin is disposed in said annular space and is intermediate said second roll and said cylindrically perforate shell.

3. An apparatus according to claim 1 wherein at least one of said cylindrically perforate shells is provided with a means for registering said cylindrically perforate shell with an axially adjacent cylindrically perforate shell.

4. An apparatus according to claim 1 wherein said protuberances have a proximal end with an annular shoulder, said annular shoulder being disposed internal to said cylindrically perforate shell and being greater in size than said holes in said cylindrically perforate shell.

5. An apparatus according to claim 1 wherein said radial anvil comprises an annular collar.

6. An apparatus according to claim 5 wherein said radial anvil comprises an internal locking assembly.

7. An apparatus according to claim 5, wherein said annular collar comprising a base roll press fitted into the proximal ends of said protuberances.

8. A pattern roll according to claim 5 wherein at least one end of said cylindrically perforate shell is provided with a means for registering said cylindrically perforate shell with an axially adjacent cylindrically perforate shell, said registering means being integral with said cylindrically perforate shell and comprising irregularities on at least one end of said cylindrically perforate shell.

* * * * *

UNITED STATES PATENT AND TRADEMARK OFFICE

CERTIFICATE OF CORRECTION

PATENT NO. : 5,356,506

DATED : October 18, 1994

INVENTOR(S) : Kevin B. McNeil, et al.

It is certified that error appears in the above-indentified patent and that said Letters Patent is hereby corrected as shown below:

| | |
|---|---|
| Column 2, lines 21-22 | delete "cylindrically" and insert therefor --cylindrical--. |
| Column 3, line 3 | before "plurality" insert --first--. |
| Column 3, line 5 | before "plurality" insert --second--. |
| Column 3, line 6 | delete "number" and insert therefor --first plurality--. |
| Column 3, lines 8-9 | delete "in the cylindrically perforate shell 40." (This phrase was repeated.) |
| Column 5, line 18 | delete "laminate" and insert therefor --laminae--. |
| Column 5, line 32 | after "structure" insert --20--. |
| Column 5, line 35 | after "structure" insert --20--. |
| Column 6, line 16 | after "28B" insert --or 28T--. |
| Column 8, line 18 | delete "130" and insert therefor --30--. |
| Column 8, line 54 | after "regions" insert --24--. |

Signed and Sealed this

Eighteenth Day of April, 1995

Bruce Lehman

*Attest:*

BRUCE LEHMAN

*Commissioner of Patents and Trademarks*

*Attesting Officer*